United States Patent [19]

Cairns et al.

[11] 4,431,252

[45] Feb. 14, 1984

[54] PRINTED CIRCUIT BOARD EDGE CONNECTOR

[75] Inventors: Thomas M. Cairns, Birmingham; David G. Connors, Canton, both of Mich.

[73] Assignee: Ford Motor Company, Dearborn, Mich.

[21] Appl. No.: 352,823

[22] Filed: Feb. 26, 1982

Related U.S. Application Data

[63] Continuation-in-part of Ser. No. 153,650, May 27, 1980, Pat. No. 4,357,066.

[51] Int. Cl.[3] ..... H01R 4/48

[52] U.S. Cl. ..... 339/176 MP; 339/252 R

[58] Field of Search ..... 339/176 MP, 258 R, 259 R, 339/252 R

[56] References Cited

U.S. PATENT DOCUMENTS

| | | | |
|---|---|---|---|
| 1,841,736 | 1/1932 | Jones . | |
| 2,799,837 | 7/1957 | Powell | 339/17 |
| 3,047,831 | 7/1962 | Majewski | 339/176 |
| 3,114,586 | 12/1963 | Albert | 339/17 |
| 3,131,017 | 4/1964 | Mittler | 339/259 |
| 3,199,065 | 8/1965 | Thompson | 339/149 |
| 3,274,532 | 9/1966 | Engel | 339/176 |
| 3,366,729 | 1/1968 | Pauza | 339/138 |
| 3,705,376 | 12/1972 | Kinkaid et al. | 339/30 |
| 3,713,080 | 1/1973 | Kennedy | 339/258 R |
| 4,068,915 | 1/1978 | Evans | 339/176 MP |

FOREIGN PATENT DOCUMENTS

| | | | |
|---|---|---|---|
| 1956183 | 9/1970 | Fed. Rep. of Germany | 339/252 R |
| 2106178 | 11/1971 | Fed. Rep. of Germany | 339/252 R |
| 1398183 | 6/1975 | United Kingdom | 339/176 MP |

*Primary Examiner*—John McQuade

*Attorney, Agent, or Firm*—Peter Abolins; Robert D. Sanborn

[57] ABSTRACT

This specification discloses a terminal for coupling to the edge of a printed circuit board with two cooperating springs to permit a reduced terminal size with increased contact pressure. The springs are restrained in a partly deflected position so they are preloaded and can provide an increased contact pressure with respect to an undeflected spring. One of the springs transmits a resisting force supplied in part by the other spring and by a forward foot which engages a portion of the terminal.

7 Claims, 12 Drawing Figures

PRINTED CIRCUIT BOARD EDGE CONNECTOR

This is a continuation-in-part of Ser. No. 153,650 filed on May 27, 1980, issued as U.S. Pat. No. 4,357,066 on Nov. 2, 1982.

BACKGROUND OF THE INVENTION

1. Field of the Invention

This invention relates to a contact structure; and, in particular, to a contact terminal for use as an edge connector for a printed circuit board.

2. Disclosure Statement

There are known various snap-in contact structures for use as an edge connector to a printed circuit board or other conductor equipped panels. Such a connector is ordinarily an elongated structure with a body part formed of an insulating material having a longitudinally extending slot or channel along one side to receive an edge portion of a printed circuit board. The insulating body part also receives a plurality of conductive terminals for making contact with conductive strips on the printed circuit board. The terminals are disposed in longitudinally spaced relation along the slot and isolated electrically from each other.

When a conductor equipped panel is inserted into the connector, the contact terminals engage and thereby make electric connections with the conductors of the panel. Each of the contact structures is connected individually to one of a plurality of lead wires. Such connection can be made before the terminals are mounted within the insulating body part. A common arrangement for establishing an interconnection between the terminals and connector body requires the terminals to be compressed or otherwise momentarily distorted during insertion thereof into the connector body. It has been found that such distortion (beyond the residual distortion after complete connection) of the contacts, although momentary, can be sufficient to give the contact a permanent set which tends to destroy the essential resilience thereof that assures the frictional grip of the contact with the aligned conductor of a panel inserted into the connector.

It is also recognized that providing an appropriate contact pressure or spring tension for the terminal can be difficult. A high contact pressure is desirable to maintain a good electrical connection between the terminal and the conductive strip on the printed circuit board. However, a relatively high contact force has a tendency to damage the conductive strips on a printed circuit board thereby causing a circuit discontinuity or limiting the number of circuit board insertions and removals without damage. On the other hand, a relatively low terminal mating or engagement force is desirable to facilitate easy insertion of the printed circuit board into the connector. That is, a large number of terminals in the connector can make insertion of the printed circuit board into the connector a difficult task.

Many known terminals for use with printed circuit boards are undesirably large for use in current automotive applications, where smaller and lighter components are being sought. Placing such terminals side by side produces an undesirably large printed circuit board and requires a larger connector. An attempt at simple downsizing of the terminal may produce a terminal with insufficient contact pressure and attendant electrical discontinuity, unreliability and customer dissatisfaction.

Among the known terminals are those which have a contact spring pivoting at the forward end of the terminal. Thus, the electrical contact point between the contact spring and the conducting strip is rearward of the spring pivot point at the forward part of the terminal. Such rearward positioning of the contact point requires a longer printed circuit board edge than would be required if the contact point were positioned closer to the forward portion of the terminal. As can be appreciated, a longer printed circuit board edge increases the weight and size of the circuit board assembly. These are some of the problems this invention overcomes.

SUMMARY OF THE INVENTION

An advantageously compact terminal for connecting to the edge of a printed circuit board provides sufficient contact pressure by the use of two cooperating spring means. The terminal has a pair of spaced, elongated side members having a front end and a back end. A first spring means is coupled to the back end of the side members and has an outside portion for contacting a conductive strip on a printed circuit board. The first spring means further including a front foot at the forward end of the first spring means for engaging a portion of the terminal when the first spring means is deflected so as to increase contact force by resisting deflection of the first spring means. The terminal also includes a second spring means coupled to the back end or rearward portion of the edge for contacting the first spring means on the side opposite from the outside portion. The combination of the first and second spring means produces increased contact pressure with improved reliability.

This terminal has a rear pivoting spring contact member so that the point of electrical connection to a conducting strip on a printed circuit board can be placed closer to the forward end of the terminal. Thus, the terminal can provide the option of having a printed board with a shorter edge portion or staggering the terminals in the direction of insertion of the printed circuit board. Such a forward and back stagger reduces the insertion force because all the terminals need not be deflected simultaneously by the insertion of the printed circuit board.

DESCRIPTION OF THE PRESENTLY PREFERRED EMBODIMENT

Figure 1:
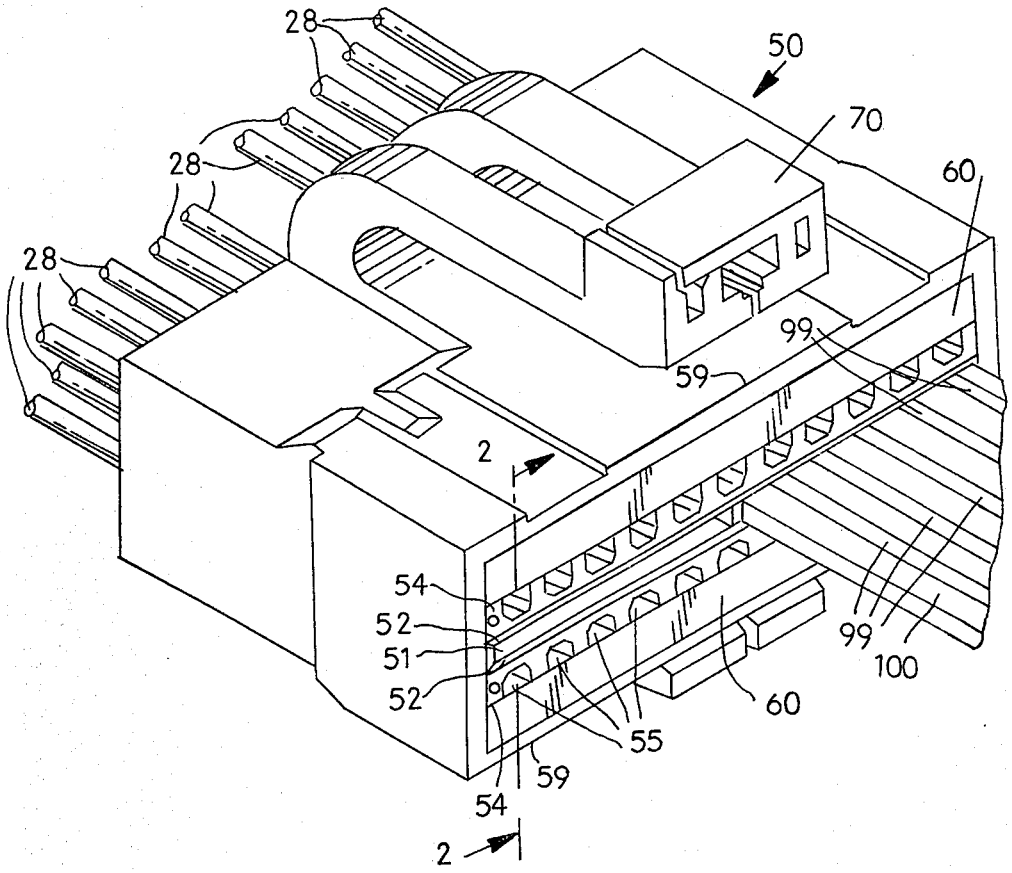
FIG. 1 is a perspective view of a connector which houses terminals connected to lead wires in accordance with an embodiment of this invention.
Figure 8:
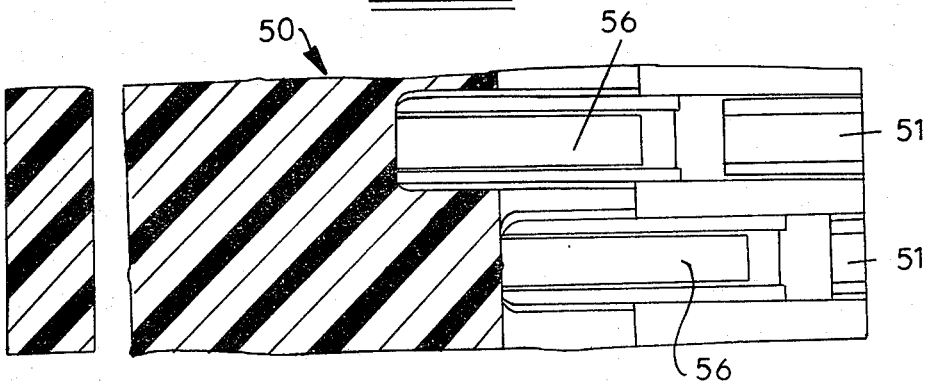
FIG. 8 is a view generally taken along line 8—8 of FIG. 4.
Figure 2:
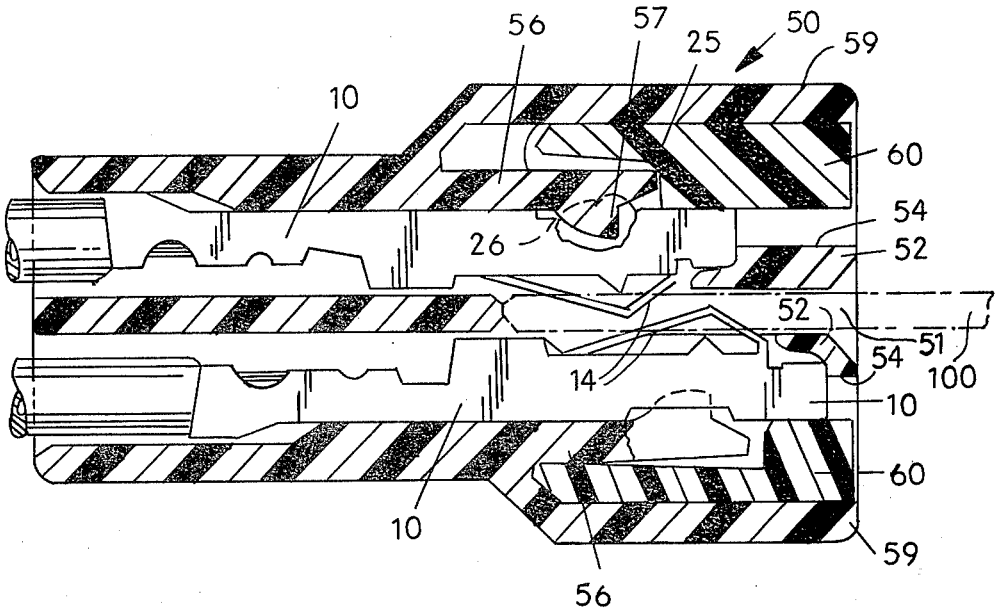
FIG. 2 is a partly section view taken generally along section line 2—2 of FIG. 1 with the terminals not sectioned.
Figure 4:
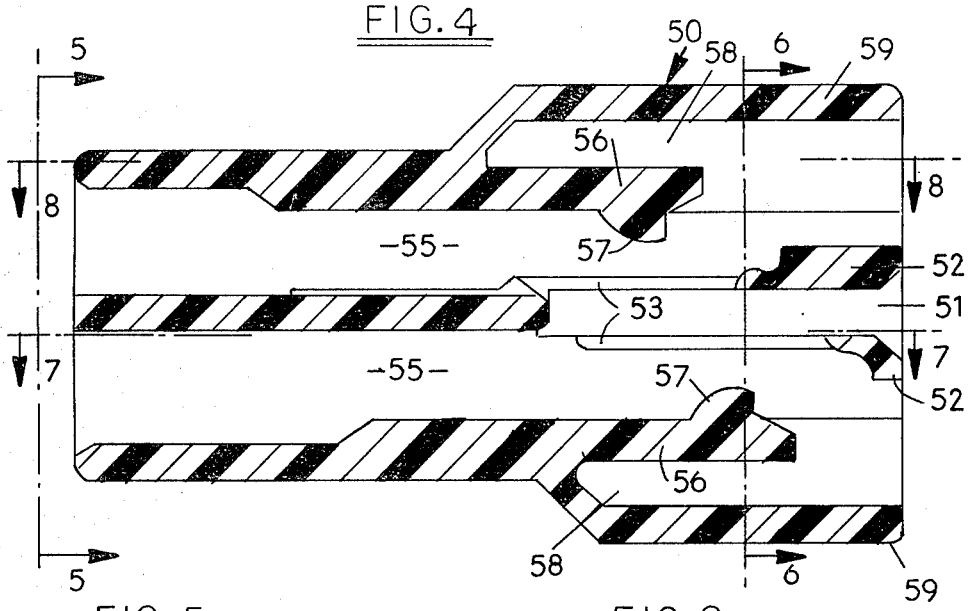
FIG. 4 is a view similar to FIG. 2 without the terminal and the spacer inserted.
Figure 5:
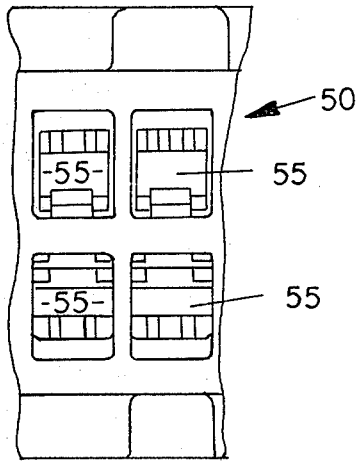
FIG. 5 is a view taken generally along line 5—5 of FIG. 4.
Figure 6:
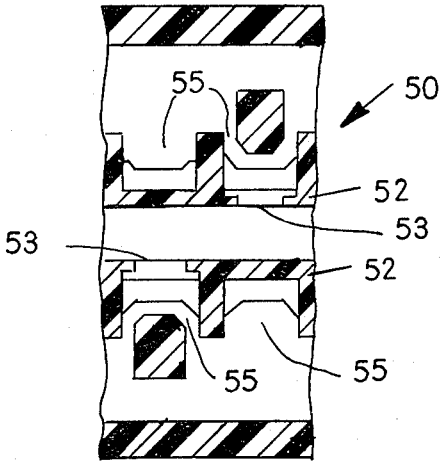
FIG. 6 is a view generally taken along line 6—6 of FIG. 4.
Figure 7:
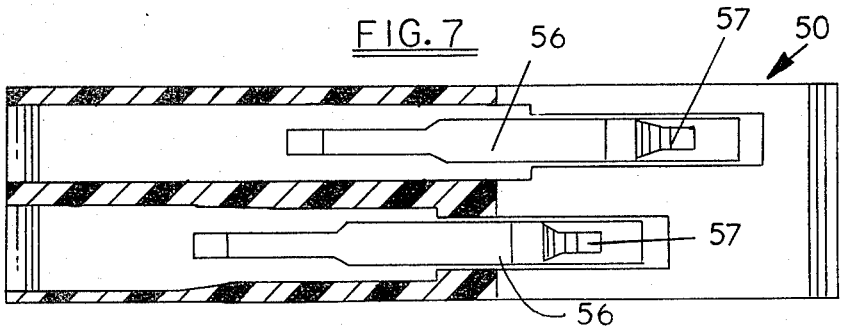
FIG. 7 is a view generally taken along line 7—7 of FIG. 4.

Referring to FIGS. 1 and 2, a plurality of generally elongated terminals 10 for contacting a conducting strip 99 at the edge of a printed circuit board 100 are positioned in a connector 50 which receives, in a slot 51, an edge of printed circuit board 100. Slot 51 is bounded by a pair of walls 52 which each have a plurality of side-by-side troughs 55 formed therein for receiving terminals 10. Troughs 55 are aligned in the direction insertion of circuit board 100 into slot 51. Contact openings 53 (FIGS. 4 and 6) in walls 52 permit a terminal 10 positioned in trough 55 to contact a conducting strip 99 on an inserted circuit board 100.

Referring to FIGS. 9–12, terminal 10 includes a rear portion 20 from which extend forward a pair of opposing, elongated, generally rectangular spaced side members 13. An elongated, curved contact spring 14 is coupled to a rear portion of one side member 13 at an upper edge 21. An elongated, curved secondary spring 15 is coupled to the rear portions of side members 13 at a lower edge 22. Secondary spring 15 is biased toward contact spring 14 and supplies a force resisting deflection of contact spring 14. Front portions 23 of side members 13 are connected by a nose clamp 16 which extends over the forwardmost portion of contact spring 14 and pre-loads contact spring 14 and secondary spring 15. Initial deflection of contact spring 14 in a preloaded condition produces a greater contact pressure than if contact spring 14 were not pre-loaded.

Figure 9:
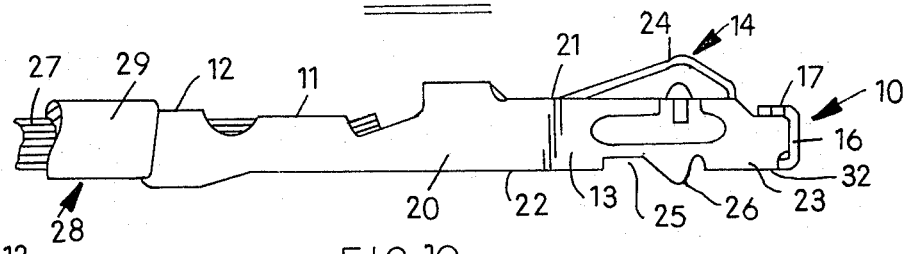
FIG. 9 is a side elevation view of a terminal in accordance with an embodiment of this invention.
Figure 11:
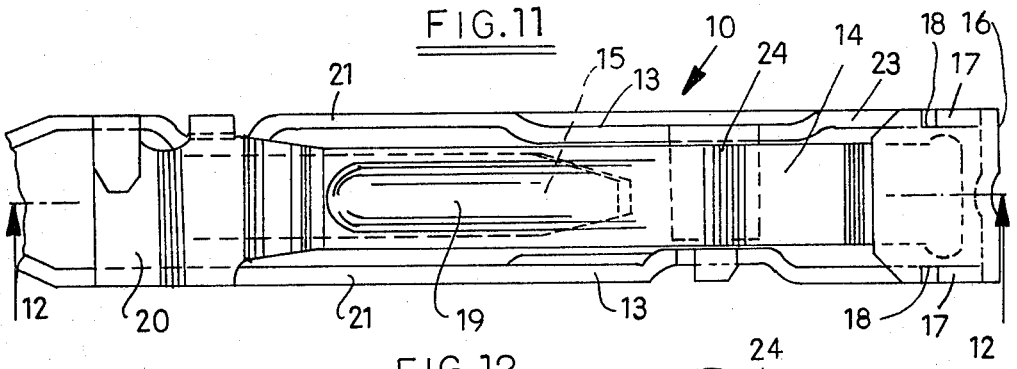
FIG. 11 is a top plan view of a portion of the terminal shown in FIG. 9.

To prevent accidental deflection of nose clamp 16 off the forwardmost portion of contact spring 14, a pair of tabs 17 extend upward from front portions 23 of side members 13 and are positioned in a pair of cooperating indentations 18 extending into the sides of nose clamp 16 thereby preventing forward motion of nose clamp 16 (FIGS. 9 and 11). Such securing of nose clamp 16 and by tabs 17 and indentations 18 is particularly advantageous when terminal 10 is unintentionally inserted upside down into connector 50 and must be removed. When no such retention is provided, removal of terminal 10 may deflect nose clamp 16 thereby freeing the forwardmost portion of contact spring 14 and causing contact spring 14 to pop up (See FIG. 12 dotted outline).

Referring to FIG. 11, contact spring 14 has a generally slight taper of decreasing width from the rear to the front of terminal 10. Additionally, contact spring 14 includes a bead or groove 19 which tapers or decreases in width from the front to the rear of terminal 10. The tapers, although in opposite directions, increase the strength of contact spring 14 adjacent the pivot point adjacent rear portion 20 of side member 13. The stress distribution on contact spring 14 is not uniform and tends to concentrate near the pivot point. To reduce unnecessary size and weight of contact spring 14 it is desirable to remove any material unnecessary for strength. As a result, the tapered width of terminal 10 and of bead 19 changes the section modulus of contact spring 14 to produce a more uniform stress in contact spring 14.

Secondary spring 15 is also tapered with the width decreasing from the rear to the front of terminal 10. As with contact spring 14, bending of secondary spring 15 produces a stress which increases toward the pivot point near rear portion 20. Accordingly, since the weight and size of secondary spring 15 can be minimized when stress is equalized throughout the secondary spring 15, less material is required near the forward end of secondary spring 15 than the rear of secondary spring 15.

Figure 12:
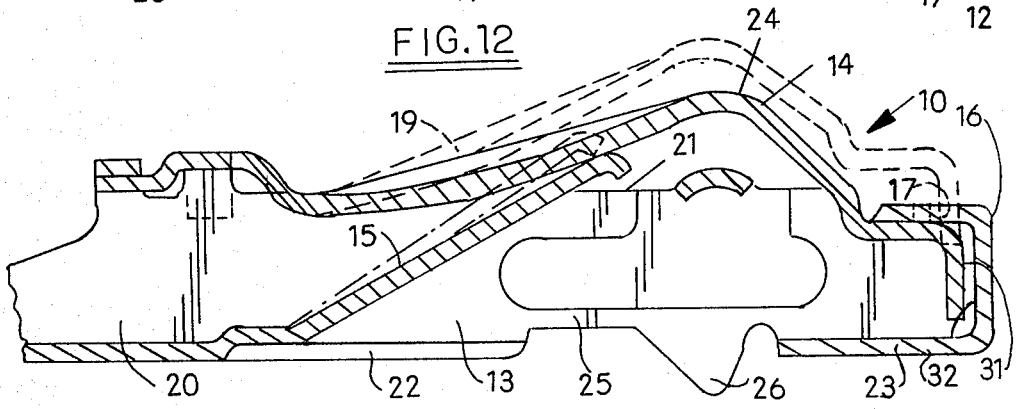
FIG. 12 is a section view along line 12—12 of FIG. 11.

Referring to FIG. 12, contact spring 14 and secondary spring 15 are shown in unloaded condition in dotted outline. FIG. 12 in full outline shows contact spring 14 and secondary spring 15 in a pre-loaded condition as positioned by nose clamp 16. Pre-loading permits a higher contact force to be applied by contact spring 14 while at the same time reducing the amount of travel required of contact spring 14 to obtain the desired force.

Reducing the travel of the spring is desirable because it permits close positioning of opposing terminals. Such positioning is desirable, for example, when contact is desired to be made to directly opposing sides of a printed circuit board. FIG. 2 shows that opposing contact springs 14 of opposing terminals 10 do not touch even when circuit board 100 is not inserted. The position circuit board, as would occupy if inserted is shown in dotted outline.

Figure 10:
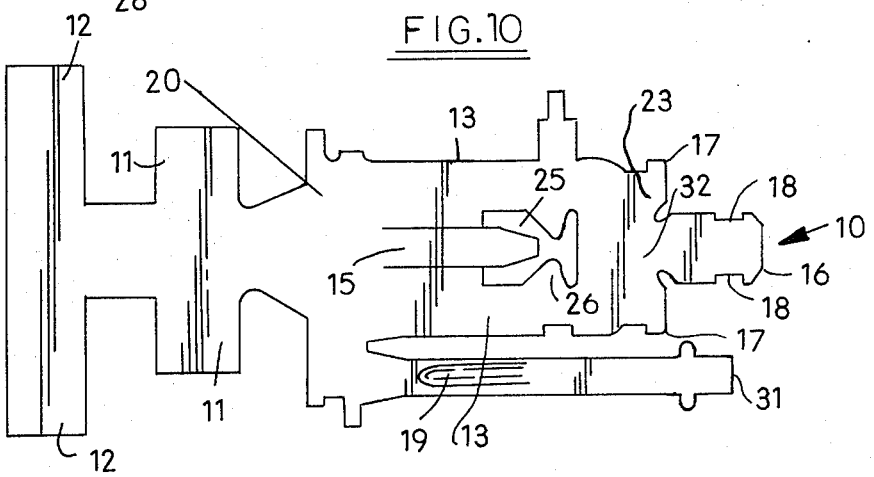
FIG. 10 is a plan view of a blank appropriate for forming a terminal in accordance with an embodiment of this invention.

Terminal 10 also includes an opening 25 between lower edges 22 of side members 13 for locking to connector 50 by receiving a protrusion 57 of a resilient securing finger (FIG. 2). A pair of tangs 26 extends downward from lower edge 22 outside member 13 adjacent opening 25. These tangs serve to guide terminal 10 on resilient finger 56 during insertion of a terminal 10 into a trough 55. Tangs 26 also polarize terminal 10 and prevent an improper orientation of terminal 10 when inserted into trough 55. Thus terminal 10 cannot be inserted upside down. Terminal 10 also includes a pair of forward prongs 11 and a pair of rear prongs 12 extending from rear portion 20. Forward prongs 11 are generally opposing and are crimped over to contact a center conductor 27 of a lead wire 28. Rear prongs 12 are also opposing and are crimped over to receive insulation 29 around center conductor 27 of lead wire 28 (FIGS. 9 and 10).

Terminal 10 further includes a foot member 31 at the forward end of contact spring 14. A floor member 32 extends between front portions 23 of side members 13. Foot 31 is at right angles to the forward portion of contact spring 14 and extends generally parallel to nose clamp 16. When contact spring 14 is preloaded as shown in FIG. 12, foot 31 extends toward but does not touch floor member 32. Accordingly, contact spring 14 can be deflected downward the distance from the bottom of foot 31 to floor member 32 before a resisting force provided by the contact of foot 31 against floor member 32 occurs. As a result, foot 32 applies to contact spring 14 an additional resisting force. The availability of this additional resisting force without further spring travel is advantageous for maintaining and achieving an increased contact force without additional spring travel. Thus the engagement of floor member 32 by foot 31 is an advantageous portion of the normal functioning of the terminal. It is a feature which comes into play when contact spring 14 is used to make electrical connection to a printed circuit board. Thus it is not a feature which is employed only in an overstressed situation. It is also advantageous that this feature is self-contained within terminal 10. That is, foot 31 does not extend through terminal 10 and strike, for example, a portion of spacer 60. Thus the occurrence of contact between foot 31 and floor member 32 is dependent only upon the tolerances of terminal 10 itself and not the tolerances of connector 50 which receives terminal 10. If connector 50 had to interact with foot 31, the positioning of terminal 10 within connector 50 and the manufacturing tolerances of connector 50 would have to be taken into account.

Figure 3:
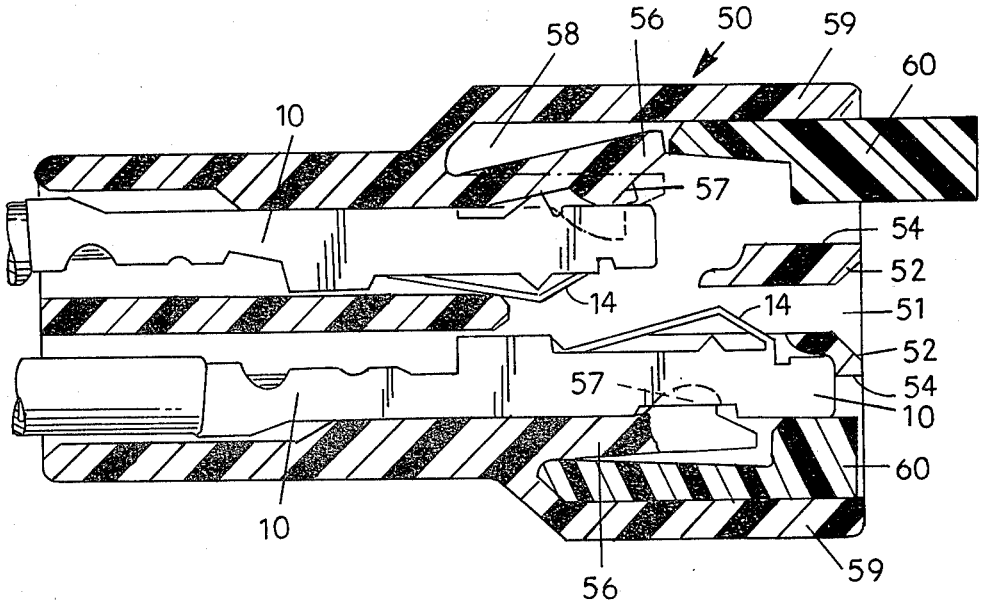
FIG. 3 is a view similar to FIG. 1 with the terminal partly inserted into the connector so that the resilient fingers are deflected and prevents the spacer from properly seating.

Referring to FIGS. 1 and 3, a connector 50 includes a slot 51 extending the width, and a portion of the depth, of connector 50 and bounded by opposing walls 52. Each of opposing walls 52 has a plurality of generally rectangular contact openings 53 for exposing a terminal 10 through wall 52. Adjacent contact openings 53 are staggered in a forward and rear direction so that insertion of the edge of printed board successively, rather than simultaneously, deflects contact springs 14 of terminals 10 thus reducing insertion force. Additionally, generally opposing contact openings 53 at the same position along the width of slot 51 are staggered in a forward and rear direction so that contact can be made to a printed board edge on opposite sides without undesirable shorting between opposing terminals 10 when printed circuit board 100 is removed from connector 50.

Outside surfaces 54 of opposing walls 52 face away from slot 51 and contain a plurality of elongated, parallel troughs 55 for receiving a terminal 10. The open long side of trough 55 has extending therealong resilient finger 56 with protrusion 57 which engages opening 25 of terminal 10. The bottom of each trough 55 includes one contact opening 53 which provides access to slot 51.

A pair of outside walls 59 are spaced from walls 52 and face outside surfaces 54 of walls 52. A pair of longitudinal spaces 58 between walls 52 and outside walls 59 each receive an elongated spacer 60. When terminal 10 is inserted into trough 55 and resilient finger 56 engages opening 25, spacer 60 fits snuggly into adjacent space 58 thereby preventing excessive play in terminal 10 or movement of resilient finger 56. Spacer 60 can be held within connector 50 by, for example, a ridge in connector 50 which engages a slot in spacer 60. As shown in FIG. 3, the use of spacer 60 prevents partial insertion of terminal 10 wherein resilient finger is deflected upward but does not engage opening 25. That is, with resilient finger 56 deflected upward, spacer 60 is blocked from completely entering space 58.

Connector 50 also includes a locking arm 70 (FIG. 1) which engages a ramp (not shown) to firmly secure connector 50 to a mounting member. This provides mechanical attachment of connector 50.

Various modifications and variations will no doubt occur to those skilled in the various arts to which this invention pertains. For example, the particular number of terminals in a connector may be varied from that disclosed herein. These and all other variations which basically rely on the teachings through which this disclosure has advanced the art are properly considered within the scope of this invention.

We claim:

1. A printed circuit board edge coupling means for contacting a conductive portion of a printed circuit board, said coupling means including a terminal comprising:

a pair of spaced, generally parallel elongated side members having a front end and back end;

a floor member extending between said side members adjacent said front end;

first spring means coupled to the back end of one of said side members adjacent a pivot point, said first spring means having an outside portion for contacting a conductive portion on the printed circuit board, so that contact to the conductive portion is forward of said pivot point, said first spring means further including a front foot at the forward end of said first spring means for engaging said floor member when said first spring means is deflected so as to increase contact force by resisting deflection of said first spring means;

a second spring means coupled to the back end of said side members for contacting said first spring means on a side opposite from said outside portion contacting the conductive portion, so that the combination of said first and second spring means produces a higher constant force with improved reliability; and said terminal including a nose clamp means for preloading said first spring means to a deflected and stressed position so that said first spring means is in a partially compressed state thus providing a higher initial contact pressure between said terminal and the conductive portion, said front foot being spaced from said floor member when said first spring means is in the deflected and stressed position.

2. A printed circuit board edge coupling means as recited in claim 1 wherein said first and second spring means are positioned so that when said first spring means is in a preloaded condition said second spring means is also in a preloaded condition and applies a reinforcing contact pressure to said first spring means.

3. A printed circuit board edge coupling means as recited in claim 2 wherein said terminal includes tabs extending from the forward portion of said side members and said nose clamp includes side indentations for receiving said tabs thereby securing said nose clamp and preventing said first spring means from becoming disengaged.

4. A printed circuit board edge coupling means as recited in claim 3 wherein said first spring means has a bead or a longitudinal groove extending generally along the longitudinal length of said first spring means, said bead being tapered with the wider portion being forward of the narrow portion thereby distributing any deflection stress over said first spring means so that the rearward portion near said pivot point of said first spring means has increased strength.

5. A printed circuit board edge coupling means as recited in claim 4 wherein said first spring means includes a taper in width, the wider portion of said first spring means being in the rear of the narrow portion of said first spring means.

6. A printed circuit board edge coupling means as recited in claim 5 wherein said second spring means has a tapered cross section modulus decreasing in cross section with increasing distance from the back end of said side members thus reducing weight and size.

7. A printed circuit board edge coupling means as recited in claim 6 wherein said terminal includes protruding tangs from a lower portion of said side members for guiding said terminal along a resilient finger portion of said coupling means and for polarizing the terminal to prevent guiding said terminal in an improper orientation with respect to said resilient finger, and said terminal includes an opening for receiving a protrusion from the resilient finger thereby locking the terminal in said coupling means.

* * * * *